United States Patent [19]

Mazdiyasni et al.

[11] 4,043,381

[45] Aug. 23, 1977

[54] SELF-DESTRUCTIVE CORE MOLD MATERIALS FOR METAL ALLOYS

[75] Inventors: Khodabakhsh S. Mazdiyasni, Xenia; Roger R. Wills, Columbus, both of Ohio

[73] Assignee: The United States of America as represented by the Secretary of the Air Force, Washington, D.C.

[21] Appl. No.: 713,090

[22] Filed: Aug. 9, 1976

[51] Int. Cl.[2] ..... B22D 23/00; B22C 1/00; B22D 29/00

[52] U.S. Cl. ..... 164/65; 164/41; 164/66; 164/132; 164/138; 249/134

[58] Field of Search ..... 164/23, 41, 72, 138, 164/61, 66, 34, 132, 65; 106/38.9; 249/134

[56] References Cited

U.S. PATENT DOCUMENTS

| | | | |
|---|---|---|---|
| 2,345,211 | 3/1944 | Neiman | 106/38.9 |
| 3,311,488 | 3/1967 | Seufert et al. | 164/41 X |
| 3,422,880 | 1/1969 | Brown et al. | 164/41 X |

FOREIGN PATENT DOCUMENTS

| | | | |
|---|---|---|---|
| 330,901 | 3/1972 | U.S.S.R. | 164/72 |

*Primary Examiner*—Ronald J. Shore
*Assistant Examiner*—Gus T. Hampilos
*Attorney, Agent, or Firm*—Joseph E. Rusz; Cedric H. Kuhn

[57] ABSTRACT

In the casting of metal alloys to form hollow articles, a mold of a desired shape containing a core material fabricated to a desired configuration from a silicon yttrium or silicon lanthanide oxynitride is filled with a molten metal alloy while maintaining the mold under a vacuum or under a blanket of an inert gas after which the mold is allowed to cool slowly to room temperature. The casted metal alloy with the core material exposed at one end is removed from the mold and heated under ambient conditions, thereby causing the silicon yttrium or silicon lanthanide oxynitride to oxidize with a large volume expansion and a concomitant catastrophic failure of the core material. The broken pieces of core material are removed from the casting which has a smooth inner surface, an indication that no chemical reactions have occurred between the alloy and the core material.

5 Claims, No Drawings

SELF-DESTRUCTIVE CORE MOLD MATERIALS FOR METAL ALLOYS

RIGHTS OF THE GOVERNMENT

The invention described herein may be manufactured and used by or for the Government of the United States for all governmental purposes without the payment of any royalty.

FIELD OF THE INVENTION

This invention relates to a method of casting metal alloys, utilizing a self-destructive core material.

BACKGROUND OF THE INVENTION

A variety of materials have been suggested for use as a core in casting hollow articles or articles having passageways or openings formed therein. One requirement of a suitable core material is that it be readily removable from the casted article. Another requirement is that the core material be non-reactive with the casting materials. Examples of core materials that have been used include glass, salt, carbon, thin walled metal shells, and ceramics.

Recent developments in the metal alloy and casting arts have rendered obsolete the prior art core materials. For example, directionally solidified cast turbine blades made from eutectic composition nickel base superalloys are the leading candidates for withstanding engine operating conditions in advanced gas turbine engines. Since these blades must be air-cooled, they must be fabricated with internal cooling passages. Normally, this is accomplished by casting the molten metal around a ceramic core which is composed of a material inert to the molten metal. Because the directional solidification of eutectic alloys requires the core body to be exposed for longer periods of time to higher temperatures than previously required in casting turbine blades, commercial core materials currently available are unsatisfactory. The lack of a suitable core material is impeding the development of a production process for manufacturing cooled turbine blades from eutectic alloys with aligned microstructures. This in turn limits the temperature capability of the blades, the turbine inlet temperature, and ultimately the improvement in performance of advanced engines.

It is an object of this invention to provide a method for casting hollow articles, utilizing a silicon yttrium or silicon lanthanide oxynitride as the core material.

Another object of the invention is to provide a method for casting superalloys and directionally solidified eutectic alloys in which a self-destructive, non-reactive core material is employed.

Other objects and advantages of the invention will become apparent to those skilled in the art upon consideration of the accompanying disclosure.

SUMMARY OF THE INVENTION

The present invention resides in a method for casting metal alloys in which a molten alloy is introduced into a mold containing a core structure or body fabricated from a silicon yttrium or a silicon lanthanide oxynitride, and preferably having a yttrium oxide coating, while maintaining the mold under a vacuum or in an inert atmosphere. After allowing the mold to cool to room temperature, the casted article with an end of the core structure exposed is removed from the mold and heated in an oxygen-containing atmosphere. In this heating step the silicon yttrium or silicon lanthanide oxynitride undergoes severe oxidation reactions accompanied by a large volume expansion which results in catastrophic failure of the core structure. The loose, broken pieces of oxidized core material are readily removed, thereby providing a hollow article having an inner surface with a smooth finish.

As used herein, the term hollow article or body refers to any object cast from a molten alloy and having a cavity, passageway or other opening formed therein by proceeding in accordance with the present method. While metals and metal alloys in general, e.g., ferrous and titanium alloys as well as superalloys, can be used in the practice of the present method, it is particularly applicable to casting hollow articles from eutectic composition nickel base superalloys. It has been found that the core material used in the present method is non-reactive with the eutectic alloys and dimensionally stable when exposed to the high temperatures and long periods of time required in casting such alloys. Of particular significance is the characteristic of the core material to expand upon oxidation as a result of which the material is self-destructed to easily removable pieces.

In general, any highly dense, polycrystalline silicon yttrium or silicon lanthanide oxynitride can be employed as a core material. Examples of oxynitrides that are preferred include those having the following formulas: $M_5(SiO_4)_3N$; $M_4Si_2O_7N_2$; and $Si_3N_4.M_2O_3$, wherein M is yttrium (Y) or an element of the lanthanide series, i.e., cerium (Ce), praseodymium (Pr), neodymium (Nd), samarium (Sm), europium (Eu), gadolinium (Gd), terbium (Tb), dysposium (Dy), holmium (Ho), erbium (Er), thulium (Tm) and ytterbium (Yb). As discussed hereinafter, the oxynitrides are formed during the procedure followed in fabricating the core structures. The preparation of these compounds is also described by R. R. Wills et al. in Journal of Materials Science 11, 749–759 (1976) and in Journal of the American Ceramic Society 59, 269–270 (1976).

In fabricating the core structures with the concomitant synthesis of the oxynitride core materials, silicon nitride ($Si_3N_4$) powder is thoroughly mixed with yttrium oxide or a lanthanide oxide ($M_2O_3$) and, in the case of the first two of the preferred oxynitrides mentioned above, silicon dioxide ($SiO_2$). The mole ratio of ingredients employed in preparing each of the preferred oxynitrides is shown by the following equations:

$$M_5(SiO_4)_3N \equiv 10M_2O_3.9SiO_2.Si_3N_4; \quad (1)$$

$$M_4Si_2O_7N_2 \equiv 4M_2O_3.SiO_2.Si_3N_4; \quad (2)$$

and $$Si_3N_4.M_2O_3 \equiv Si_3N_4.M_2O_3. \quad (3)$$

Mixing of the ingredients can be conveniently accomplished by utilizing a ball mill which ensures the communication of any agglomerates and the provision of a homogeneous mixture in powder form.

In one procedure, the mixture of powdered ingredients is compacted by uniaxially cold pressing (room temperature) the mixture in a steel die at a pressure ranging from about 2000 to 30,000 psi. Alternatively, the mixture can be isostatically cold pressed at a pressure ranging from about 2000 to 30,000 psi. The isostatic pressing is carried out by placing the compacted mixture in a neoprene bag which is then subjected in a hydraulic cylinder to a pressure in the aforementioned range.

In another procedure, the mixture of ingredients is mixed with a binder in an amount sufficient to provide a mixture having a pastelike consistency. Examples of binders that can be used include alcohols, such as ethanol, isopropanol and butanol, and hydrocarbons, such as benzene, toluene, xylene and cyclohexane. A body of any desired shape is then formed by subjecting the paste-like mixture to injection molding or slip casting in accordance with conventional practices. After the injection molding or slip casting operation, the molded or casted body is dried, e.g., by heating under a vacuum, e.g., $10^{-1}$ to $10^{-3}$ torr, or in an inert atmosphere at about 100° to 130° for 12 to 48 hours. Examples of gases that can be used to provide an inert atmosphere include nitrogen, argon, helium and ammonia. The body is then heated under a vacuum or in an inert atmosphere at a temperature ranging from about 400° to 500° C for a period of about 4 to 12 hours for the purpose of evaporating or burning off the organic vehicle contained in the body.

The body formed as described in the preceding paragraphs is then sintered by heating in an inert atmosphere at a temperature ranging from about 1500° to 1800° C for a period of about 1 to 3 hours or longer. In this sintering step, the mixture of ingredients constituting the body undergoes a reaction whereby a silicon yttrium or silicon lanthanide oxynitride core material is formed.

While the core body prepared as described above can be employed in carrying out the method of this invention, it is usually preferred to provide the body with a thin coating of yttrium oxide. To this end a thin layer of yttrium metal, e.g., about 4000 to 5000 angstroms thick, is coated on the body by vapor deposition. This is accomplished by heating the body under a vacuum and in the presence of yttrium at a temperature in the range of about 1450° to 1550° C for a period of about 1 to 3 hours. Thereafter, the body coated with yttrium is heated at about 600° to 800° C for about 1 to 3 hours in an oxidizing atmosphere, such as air, so as to convert the yttrium metal to yttrium oxide. The presence of the yttrium oxide coating provides several advantages. For example, it obviates the possibility of mechanical bonding between the core body and the metal alloy. Furthermore, the coating ensures that the core body will have a smooth surface that is free of pores.

In conducting the method of this invention, the core body having a desired geometry is positioned in a mold also having a desired geometry. It is to be understood that more than one core body can be disposed in a mold. For example, in casting a turbine blade from eutectic composition nickel base superalloys, a plurality of core bodies is positioned in a mold so as to provide air passages through the blade. The core bodies are disposed so that at least one end of each body is exposed when the casted article has cooled to room temperature and has been removed from the mold. The procedures followed in fabricating molds are well developed, and it is well within the skill of the art to prepare a mold for forming an article having a desired shape. Examples of materials that can be used in fabricating molds include yttria, alumina, fused silica, and the like.

After the molten metal alloy has been poured into the mold containing a core body formed of a silicon yttrium or silica lanthanide oxynitride, the alloy is allowed to cool to room temperature. During this operation, the mold is maintained under a vacuum or under a blanket of an inert gas. The cooled, casted article with an end of the core body exposed is removed from the mold and heated in an oxidizing atmosphere, such as air, at a temperature ranging from about 850° to 1100° C for a period of about 12 to 120 hours. As a result of this heating step, the oxynitride core material undergoes a severe oxidation reaction which is accompanied by a large volume expansion of the material. The large volume expansion results in a catastrophic failure of the core body with the formation of crached or loose, broken pieces that are readily removable from the casting. The inner surface of the casted alloy presents a smooth finish, thereby indicating that no chemical reaction occurs between the core material and the alloy.

A more complete understanding of the invention can be obtained by referring to the following illustrative examples which are not intended, however, to be unduly limitative of the invention.

EXAMPLE I

A series of runs was conducted in which yttrium silicon oxynitride core materials were prepared. The oxynitrides prepared and the mole ratios of the ingredients used in their preparation were as follows:

| Oxynitride | $Y_2O_3$:$SiO_2$:$Si_3N_4$ |
|---|---|
| $Y_5(SiO_4)_3N$ | 10:9:1 |
| $Y_4SiO_7N_2$ | 4:1:1 |
| $Si_3N_4 \cdot Y_2O_3$ | 1 :1 |

In each run, the ingredients in the above-indicated mole ratios were ball milled so as to obtain a uniform mixture in powder form. The mixture was uniaxially cold pressed in a steel die at 3000 ksi. Each preformed body was dried at 120° C for 24 hours and then sintered in a nitrogen atmosphere for 60 minutes at 1750° C. No appreciable dimensional changes were observed during sintering. Grayish white to grayish black specimens with densities 60–75 percent of theoretical (4.05–4.2 g/cm$^3$) were obtained. A typical microstructure obtained consisted of elongated and polygonal grain, 2–5 $\mu$m in grain size. The X-ray powder diffraction pattern using $CuK_{6\alpha}$ radiation indicated silicon yttrium oxynitride.

The silicon yttrium oxynitride bodies were oxidized by firing in a muffle furnace at ambient condition at 1000° C for 96 hours.

The $Y_5(SiO_4)_3N$ had an oxidation weight gain of 1.2 weight percent and a volume expansion of 35 percent. The reaction product had a relatively simple diffraction spectrum which, except for the relative intensities, was similar to that of $Y_5(SiO_4)_3N$. The new phase was indexed on a similar hexagonal unit cell having lattice parameters $a$ = 9.347A and $c$ = 6.727A, the yttrium form of an oxysilico apatite of the general formula $R_{4.67}(SiO_4)_3O$. The oxidation reaction can, therefore, be represented by the following equation:

$$Y_5(SiO_4)_3N + 0.75O_2 \rightarrow Y_{4.67}(SiO_4)_3O + 0.165Y_2O_3 + 0.5N_2$$

Weight change = 1.4%

The $Y_4SiO_7N_2$ had an oxidation weight gain of 3.7 weight percent and a volume expansion of about 11 percent. The diffraction spectrum of the reaction product showed the presence of the $Y_{4.67}(SiO_4)_3O$ phase together with some $Y_2O_3$. These observations are consistent with the oxidation reaction represented by the following equation:

$$1.5Y_4SiO_2O_7N_2 + 2.25O_2 \rightarrow Y_{4.67}(SiO_4)_3O + 1.5\ N_2 + 0.665Y_2O_3.$$

Weight change = 3.7%

The $Si_3N_4 \cdot Y_2O_3$ had an oxidation weight gain of 9.0 weight percent and a considerable volume expansion. Since the body was no longer in one piece, it was not possible to measure accurately the volume expansion. However, the expansion was estimated to be about 120 percent. The diffraction spectra of the reaction product were very complex. However, after further treatment at 1200° C for 1 hour, the material appeared to be entirely $Y_2O_3 \cdot 2SiO_2$. These results are consistent with the oxidation reaction represented by the following equation:

$$Si_3N_4 \cdot Y_2O_3 + 3O_2 \rightarrow Y_2O_3 + 3SiO_2 + 2N_2 \xrightarrow{1200^\circ C} Y_2O_3 \cdot 2SiO_2 + SiO_2 + 2N_2$$

Weight change = 10.9%

Since the theoretical densities of $Y_2O_3 \cdot 2SiO_2$ and $Si_3N_4 \cdot Y_2O_3$ are 4.05 g/cm³ and 4.2 g/cm³, respectively, transformation of the oxynitride to the silicate could not account for the large observed volume change. The expansion is believed to be due to the formation of $SiO_2$ (density ~ 2.3 g/cm²) at an intermediate stage in the reaction. Experimental evidence for this was found in samples fired at 900° C for several days, the diffraction spectra of the reaction product being typical of one containing a large amount of amorphous phase. The tremendous stresses generated by this amorphous phase as it attempts to assume its natural density account for the catastrophic failure of the structure.

EXAMPLE II

A 10 g equimolar mixture of silicon nitride ($Si_3N_4$) and yttrium oxide ($Y_2O_3$) was cold pressed in a steel die at 3000 psi. The compacted body was then sintered in a nitrogen atmosphere for 1 hour at a temperature of 1750° C to produce a porous silicon yttrium oxynitride body (60% theoretical density). A 5000 angstrom thick yttrium layer was vapor deposited on the surface of this core material and converted to $Y_2O_3$ by oxidation at 700° C. The coated silicon yttrium oxynitride core was immersed in a molten nickel-based superalloy (NiTaC-13, General Electric) contained in a yttria crucible. The directionally solidified eutectic superalloy had the following composition:

| | Weight % |
|---|---|
| C | 0.54 |
| Ta | 8.20 |
| W | 3.1 |
| Re | 6.2 |
| Al | 5.4 |

-continued

| | Weight % |
|---|---|
| V | 5.6 |
| Co | 3.2 |
| Cr | 4.4 |
| Ni | Balance |

The crucible containing the core material was maintained under a vacuum for 4 hours while slowly cooling to room temperature. No visible chemical reactions occurred between the superalloy and the core material. The cooled casted superalloy with the core material exposed at one end was placed in a muffle furnace at ambient condition and fired at a temperature of 800° to 1000° C for 48 hours. During this period the yttrium silicon oxynitride core body underwent severe oxidation reactions accompanied by a large volume expansion. As a result, the core body self-destructed to loose, broken pieces which were readily removed after the casted alloy had cooled. The smooth inner surface of the casted alloy indicated that there had been no chemical reactions between the alloy and the core body.

As seen from the foregoing, the present invention provides a method for casting superalloys and directionally solidified eutectic superalloys whereby the core is readily removed by oxidation without any deleterious effect on the microstructure of the casted alloy and without damage to its surface. Thus, the present method solves the problems of molten metal reactions with core mold bodies, maintenance of dimensional stability during casting, avoidance of hot tearing of the casted alloys, and removal of core bodies from fabricated parts.

As will be evident to those skilled in the art, modifications of the present invention can be made in view of the foregoing disclosure without departing from the spirit and scope of the invention.

We claim:

1. A method for casting metal alloys to form a hollow article which comprises introducing molten metal alloy into a mold containing a core body fabricated from a silicon yttrium oxynitride or a silicon lanthanideoxynitride, the mold being under a vacuum or in an inert atmosphere.

2. The method according to claim 1 in which the core body is fabricated from a material selected from the group consisting of oxynitrides having the following formulas: $M_5(SiO_4)_3N$; $M_4Si_2O_7N_2$; and $Si_3N_4 \cdot M_2O_3$, wherein M is yttrium of an element of the lanthanide series.

3. The method according to claim 2 in which the fabricated core body is coated with a layer of yttria.

4. The method according to claim 3 in which the mold is cooled to room temperature; a cast article with an end of the core body exposed is removed from the mold; and the cast article is heated in an oxygen-containing atmosphere.

5. The method according to claim 4 in which the cast article is heated in air at a temperature ranging from about 850° to 1100° C for a period of about 12 to 120 hours.

* * * * *